US005697465A

United States Patent [19]

Kruse

[11] Patent Number: 5,697,465

[45] Date of Patent: Dec. 16, 1997

[54] PERSONAL MOBILITY VEHICLE

[76] Inventor: Thomas E. Kruse, 8135 25th Ct. East, Sarasota, Fla. 34243

[21] Appl. No.: 419,153

[22] Filed: Apr. 10, 1995

[51] Int. Cl.[6] ..... A61G 5/04

[52] U.S. Cl. ..... 180/65.1; 180/907

[58] Field of Search ..... 180/65.1, 65.6, 180/65.7, 6.5, 907, 304.1, 250.1

[56] References Cited

U.S. PATENT DOCUMENTS

| | | | |
|---|---|---|---|
| 2,586,273 | 2/1952 | Steven . | |
| 3,566,986 | 3/1971 | Udden . | |
| 3,820,790 | 6/1974 | Peterson . | |
| 5,022,476 | 6/1991 | Weege | 180/907 |
| 5,249,636 | 10/1993 | Kruse et al. | 180/907 |

*Primary Examiner*—Richard M. Camby
*Attorney, Agent, or Firm*—A. W. Fisher, III; Charles J. Prescott

[57] ABSTRACT

A personal mobility vehicle having a low center of gravity and compact overall size which facilitates travel in narrow hallways and in negotiating sharp turns both indoors and out of doors on smooth and uneven surfaces. The vehicle includes a generally horizontally disposed frame supported in close proximity above the ground by a pair of side-by-side spaced steerable rear wheels and two spaced motor-driven front wheels. A battery arrangement is connected to and supported by the frame and operably connected between a control lever in electrical communication with an electronic circuit and the motors for propelling the front wheels through a transaxle arrangement and for steering the rear wheel. By the side-by-side spaced rear wheel arrangement, steering angles of up to about 90° are achieved without stalling propulsion. A seat is provided whereby a user's feet may be comfortably supported on the frame or separate removable or fixed foot rests. Outrigger type anti-scuff and anti-tip wheels are also provided and may be in combination with a forwardly positioned ramp assist wheel connected beneath a forwardly perimeter of the frame to assist the vehicle in travelling over a ramp or bump.

9 Claims, 4 Drawing Sheets

PERSONAL MOBILITY VEHICLE

SCOPE OF THE INVENTION

This invention relates generally to self-propelled personal mobility vehicles for the handicapped and physically impaired, and more particularly to a compact, low center-of-gravity personal mobility vehicle which is uniquely adapted to be highly maneuverable in tight places and propellable by transaxle-driven front wheels over various types of terrains.

PRIOR ART

Presently, a broad array of self-propelled personal mobility vehicles for use by the handicapped and physically impaired are either patented and/or marketed. These vehicles are almost exclusively motorized and battery powered and consist of either three or four ground engaging wheels. However, the three wheeled tricycle-type version appears most popular. The drive arrangement may include a propulsion motor operably connected to either one or both of the rear drive wheels or incorporated into a front steerable wheel.

Typically, these available and/or known personal mobility vehicles are relatively massive in structure, some of which are also designed for outdoor operation in grass and dirt. Additionally, the center of gravity of the user seated atop such available vehicles is relatively high, producing somewhat compromised stability.

In the typical front wheel steering vehicle, a steering tiller is incorporated to be manually operated by the rider. As a result, these vehicles are relatively long to accommodate the steering tiller and must be entered from the side to get behind the tiller. Such vehicles also prohibit driving up to and under a table due to the presence of the steering tiller in the front of the vehicle.

A number of patented prior art device listed herebelow include a steerable rear wheel in combination with spaced front wheels for a wide range of vehicles. However, none discloses a personal mobility vehicle for transporting a person which includes the maneuverability and structural features of the present invention.

| | |
|---|---|
| 2,482,203 | Peterson, et al. |
| 2,586,273 | Steven |
| 2,644,540 | Balzer |
| 3,110,352 | McClamon |
| 3,137,869 | Johnson |
| 3,566,986 | Udden |
| 5,121,806 | Johnson |

A further limitation of personal mobility vehicles presently known to applicant resides in the limited ability of these larger vehicles to negotiate narrow hallways, to avoid running over the toes of others nearby on foot, and to be able to maneuver in dimensionally tight environments.

One prior art device which overcomes this limitation is disclosed in applicants' previous U.S. Pat. No. 5,249,636. This invention, however, is extremely compact and is best suited primarily for indoor use and on paved surfaces.

Another prior art device co-invented by applicant and disclosed in application Ser. No. 08/150,409 filed Nov. 10, 1993 and bearing an issue date of May 9, 1995 teaches a personal mobility vehicle having a steerable motor driven rear wheel and two spaced front wheels operably connected for free rotation to a frame. Anti-tipping wheels and a ramp assist wheel are also disclosed.

The present invention provides a very maneuverable, low center of gravity personal mobility vehicle which, in the preferred embodiment, will easily maneuver down narrow hallways, through narrow doorways at 90 degrees to such hallway, and into other dimensionally tight situations. An electronically controlled motor-positioned pair of spaced rear steerable wheels is also provided, thus eliminating the front tiller. This invention also includes a compact transaxle positioned between the spaced front wheels for shared driving rotation between the front wheels without compromising turning maneuvers.

BRIEF SUMMARY OF THE INVENTION

This invention is directed to a personal mobility vehicle having a low center of gravity and compact overall size which facilitates travel in narrow hallways and in negotiating sharp turns as into a doorway along a narrow hall. The vehicle includes a generally horizontally disposed frame supported in close proximity above the ground by two spaced apart steerable rear wheels and two spaced motor-driven front wheels. A battery arrangement is connected to and supported by the frame and operably connected between a control lever in electrical communication with an electronic circuit and the motors for differentially propelling the front wheels and for steering the rear wheel. A seat is provided whereby a user's feet may be comfortably supported on the frame. By the side-by-side spaced rear wheel arrangement, steering angles of up to about 90° are achieved without stalling propulsion. Outrigger type anti-scuff and anti-tip wheels are also provided and may be in combination with a forwardly positioned ramp assist wheel connected beneath a forwardly perimeter of the frame to assist the vehicle in travelling over a ramp or bump.

It is therefore an object of this invention to provide a self-propelled personal mobility vehicle for transporting an individual which is extremely compact in size and maneuverable in tight quarters.

It is another object of this invention to provide such a personal mobility vehicle which provides easy frontal access to the seat area and also has a very low center of gravity and improved lateral stability.

And yet another object of this invention is to provide a personal mobility vehicle having a pair of spaced side-by-side rear steerable wheels which greatly enhance maneuverability and compactness.

It is yet another object of the present invention to provide an extremely maneuverable personal mobility vehicle which is readily adapted for outdoor use and easily able to negotiate over ramps, bumps and uneven terrain while maintaining a low profile and center of gravity.

In accordance with these and other objects which will become apparent hereinafter, the instant invention will now be described with reference to the accompanying drawings.

DETAILED DESCRIPTION

Figure 2:
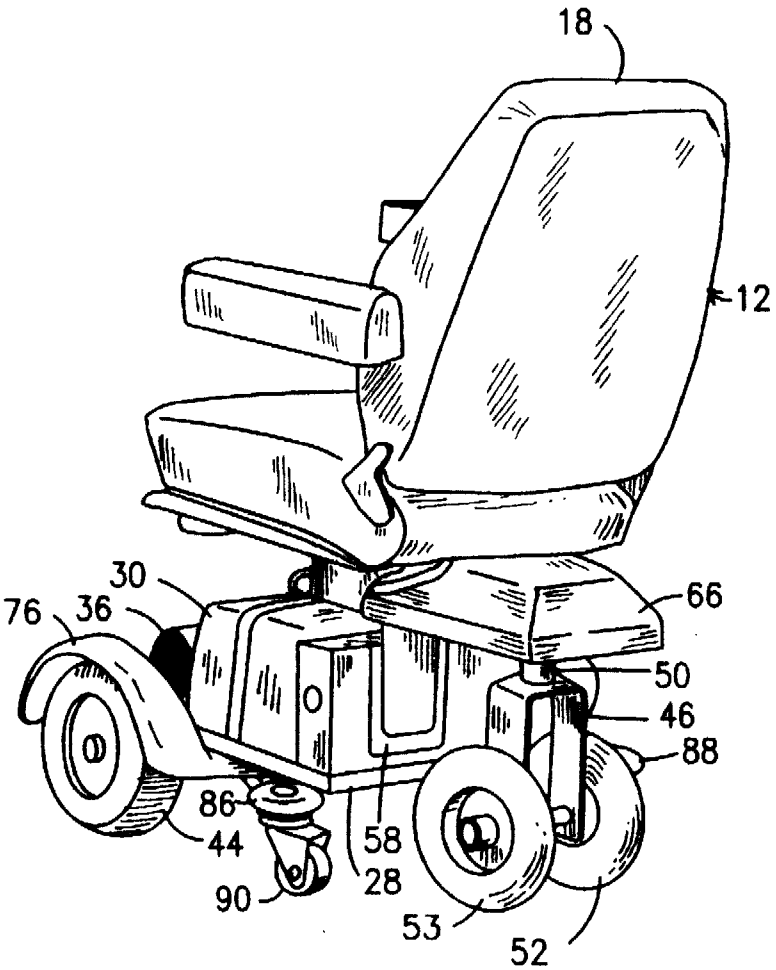
FIG. 2 is a rear left perspective view of the invention shown in FIG. 1.
Figure 1:
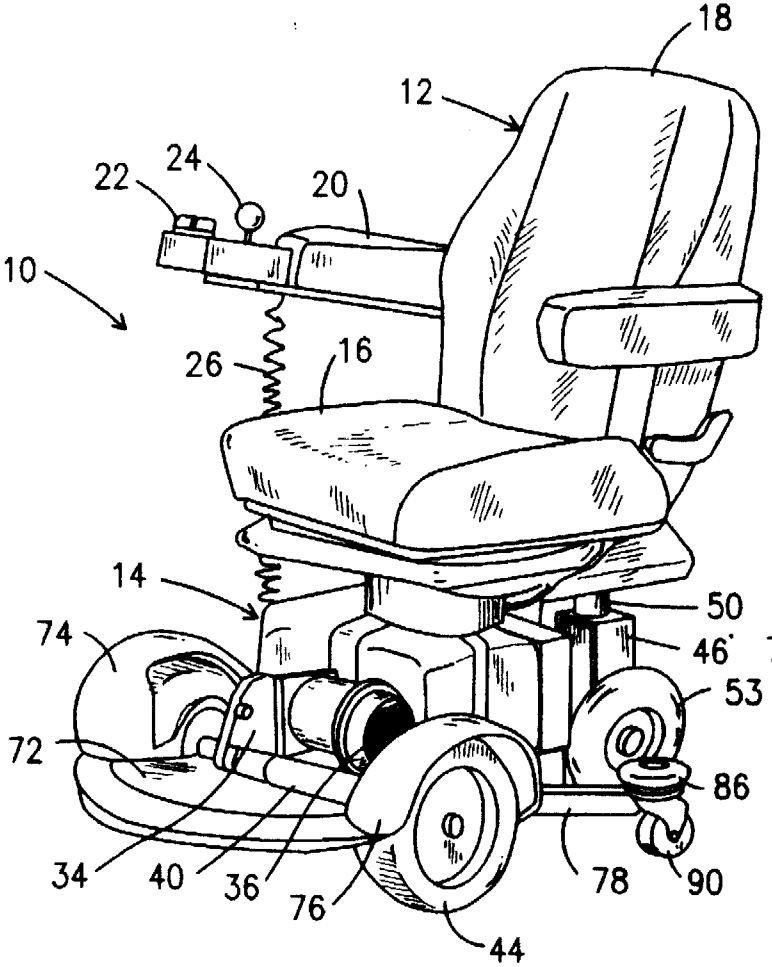
FIG. 1 is a front left perspective view of the invention.
Figure 3:
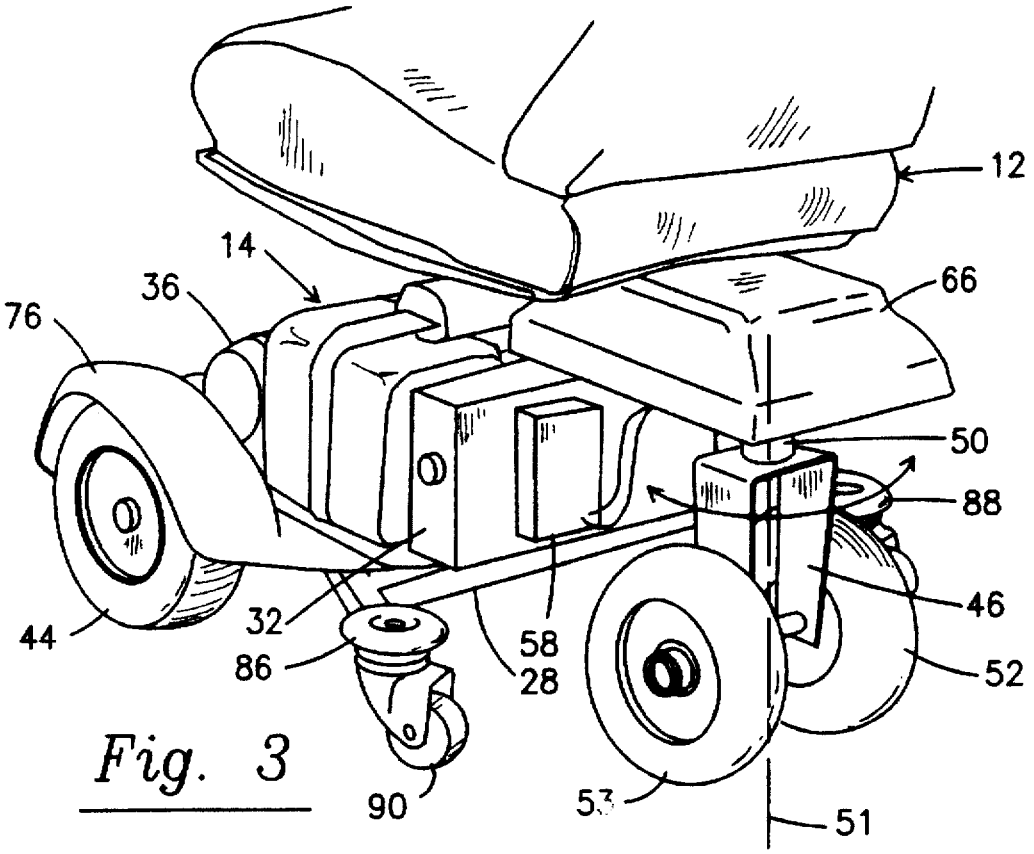
FIG. 3 is an enlarged perspective view of FIG. 2.
Figure 4:
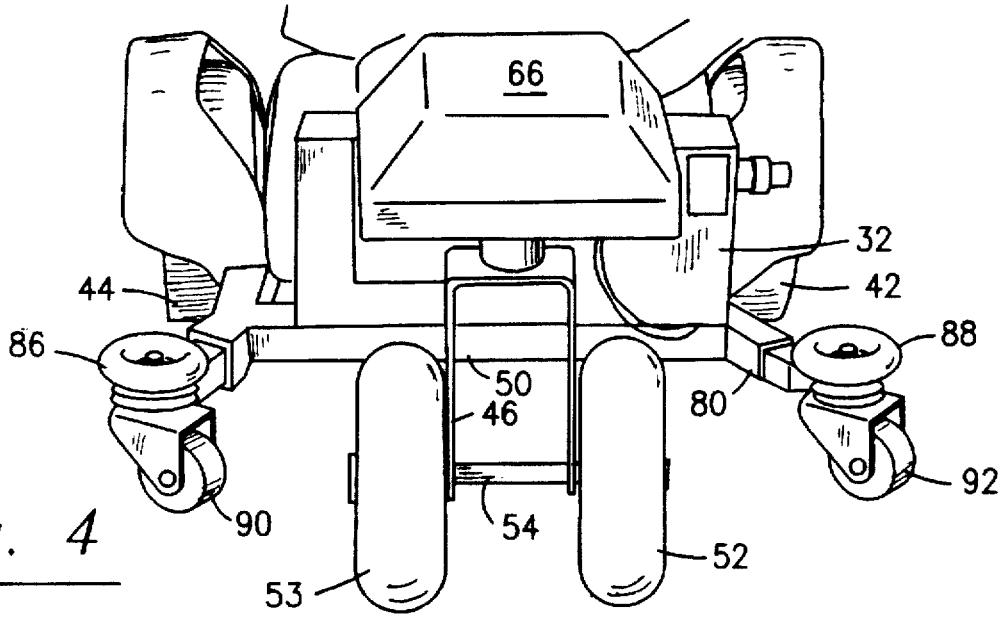
FIG. 4 is a rear perspective view of FIG. 3.

Referring now to the drawings, and particularly to FIGS. 1 to 6, the invention is generally shown at numeral 10 and includes a seat assembly 12 operably supported atop a chassis 14. The seat assembly 12 includes a seat bottom 16 and a seat back 18 rigidly connected one to another and a pair of arm rests 20 (typical). Attached to the right arm rest 20 is a control box 22 having a "joy stick" type control 24 for controlling movement and steering of the vehicle 10 as will be described herebelow.

Figure 5:
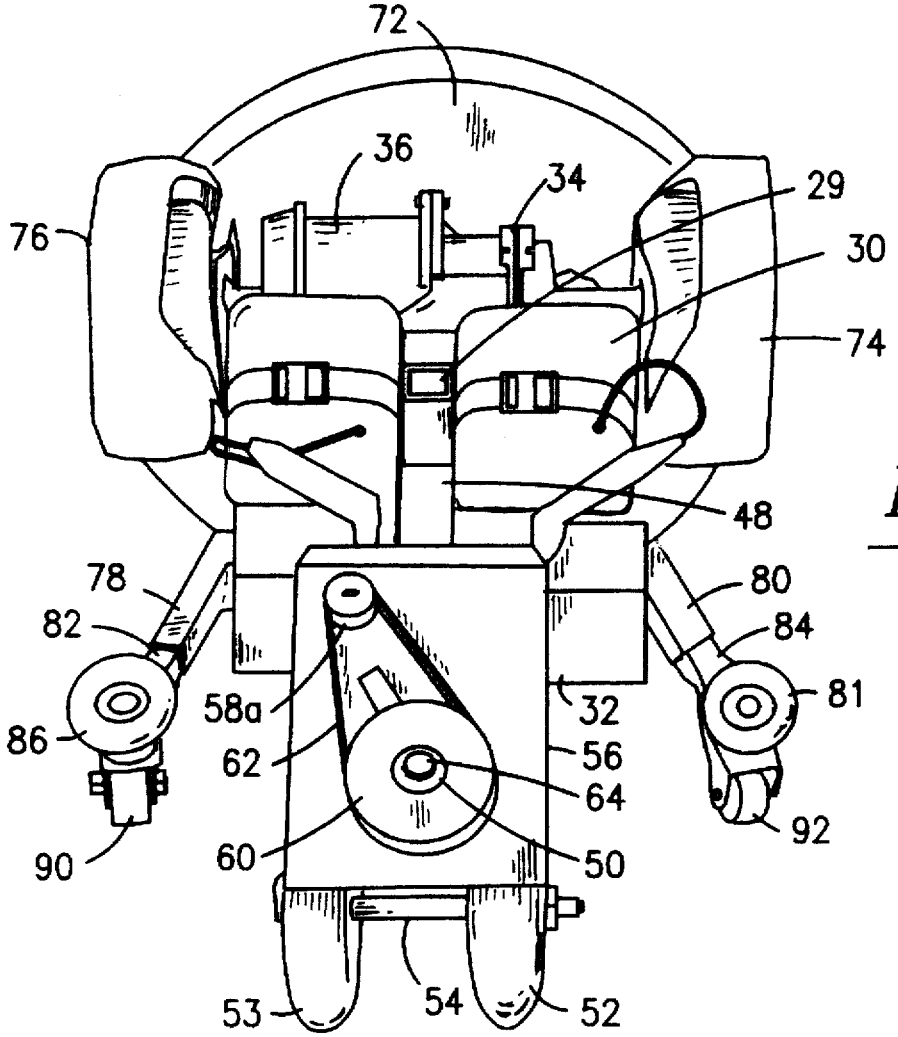
FIG. 5 is a top plan view of the invention shown in FIG. 1 with the seat removed.
Figure 6:
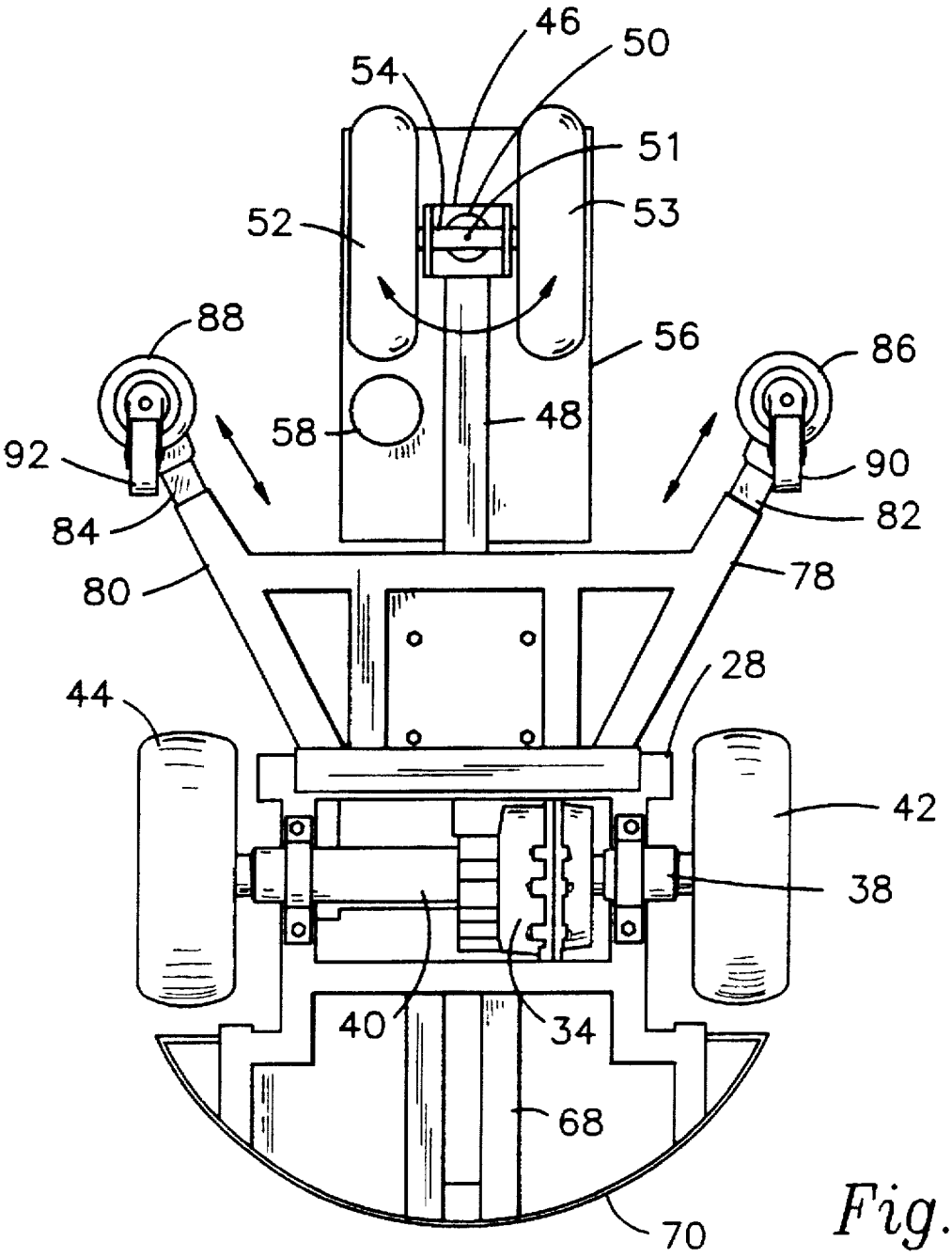
FIG. 6 is a bottom plan view of FIG. 5.

The chassis 14 includes a rigid steel frame 28 formed of tubular members as best seen in FIGS. 5 and 6. Two symmetrically spaced apart front wheels 42 and 44 are operably mounted for driven rotation on output shafts (not shown) contained within tubular housings 38 and 40. A compact transaxle assembly 34 drivingly engages the output shafts (not shown) to each of the wheels 42 and 44 in a shared power flow arrangement which provides generally even traction to each of the wheels 42 and 44 while also providing for a differential rate of rotational movement therebetween during turning maneuvers. Rough terrain traction is also improved as the front wheels 42 and 44 bear most of the weight and "pull" rather than push from behind. An electric motor 36 operably connected to batteries 30 by control circuitry (not shown) within electronic control box 32 supplies power to the motor 36 which is controlled by fore and aft movement of joy stick 24.

The rear of the chassis 14 is supported by a pair of spaced apart centrally positioned rear wheels 52 and 53 held for free rotation on axle 54 which, in turn is held within turning fork 46 for supportive dependent rotation by steering shaft 50. As best seen in FIG. 5, the steering shaft 50, receiving support from frame member 48, is operably connected to steering gear 60 which, in turn, is operably connected to steering motor 58 through gear 58*a* by drive belt 62. A feedback potentiometer 64 provides an input signal to the control box 32 for constantly monitoring steering shaft 50 rotational orientation. A mounting tray 56 is provided to support these steering components and wiring, all being enclosed by fiberglass or A.B.S. cover 66.

The benefit of the side-by-side dual rear wheel arrangement may be appreciated when considering the steering maneuverability built into the present invention 10. Steering motor 58 is provided with the controlled capability of rotating steering shaft 50 and rear wheels 52 and 53 through an angle of up to about 90° with respect to the longitudinal axis of the vehicle 10. This tremendously large steering angle provides the high degree of maneuverability in turning in virtually its own length in tight quarters where required. However, if only a single rear wheel were utilized, the rear wheel itself would, when turned to approaching 90° with respect to the longitudinal axis, scuff or drag sideways rather than turn the vehicle as intended. The dual wheel arrangement, however, indeed turns the vehicle in very short turning radius even when the steering angle approaches 90°. An additional factor of steering maneuverability and extreme steering angles is provided by the fact that fork 46 is preferably "non-trailing" in that there is no castor offset whatsoever between the steering axis 51 and the horizontal axle 54. Although certain amounts of castor may be incorporated within the scope of this invention, the preferred embodiment is thus structured without any castor offset whatsoever.

The seat 12 is mounted within upright 29 of frame 28 and, on that basis is easily removable by lifting the seat 12 upwardly. The fixed tubular support 29 may alternately be replaced with a power lift arrangement so that the seat 12 is upwardly and downwardly repositionable by a power actuator.

To help prevent excess lateral tipping of the vehicle 10 during sharp cornering maneuvers, a pair of anti-tip wheels 90 and 92 are mounted for free rotation within their respective castor housings which, in turn, are mounted for free rotation about an upright axis on support tubes 82 and 84. These support arms 82 and 84 are adjustable in the direction of the arrows in FIG. 5 within support tubes 78 and 80 rigidly connected and apart of frame 28.

These anti-tip wheels 90 and 92 are positioned slightly above a flat support surface atop which the vehicle 10 is resting in its static position. The clearance between the support surface and anti-tip wheels 90 and 92 is provided so that they only come in contact with the support surface when the vehicle 10 begins to lean laterally in one direction or the other as during a sharp cornering maneuver. Note that, by extending support arms 82 and 84, the amount of tolerable leaning rotation is thereby also adjusted in direct proportion to the amount of extension of support arms 82 and 84 within support tubes 78 and 80, respectively.

Anti-scuff rollers or bumpers 86 and 88 are connected to support arms 82 and 84 positioned above the anti-tip wheels 90 and 92 respectively. These anti-scuff rollers 86 and 88 are freely rotatable about an upright axis for preventing the accidental contact with the wall by any other part of the rear of the vehicle 10.

A molded fiberglass or A.B.S. deck 72 supported by frame members 68 and arcuate forwardly perimeter frame 70 as best seen in FIG. 6, provides a horizontal area upon which the user may place feet. This molded deck area 72 also includes molded fenders 74 and 76 for covering the front wheels 42 and 44. This deck area 72 is shown with openings around the front wheels 42 and 44 for clarity only and would otherwise be solid and continuous in this fender area.

Figure 7:
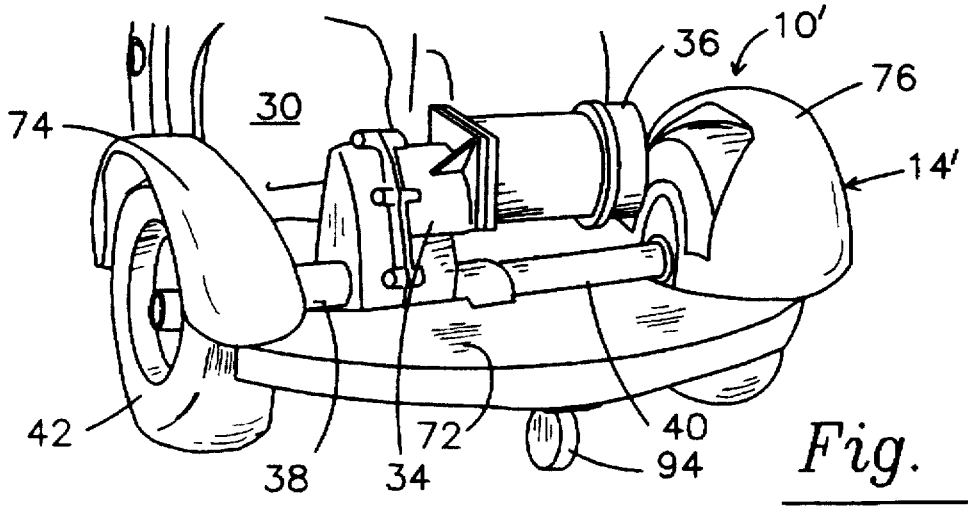
FIG. 7 is an enlarged front right perspective view showing a preferred embodiment of the invention.

As seen in FIG. 7, the invention may also be provided shown generally at 10' to include a ramp assist wheel 94 which is centrally mounted within a support member positioned between frame members 68 as best seen in FIG. 6. This ramp assist wheel 94 is freely rotatable about a transverse axis and is provided to prevent the forwardly perimeter 70 of frame 28 from scraping or jamming into a ramp, curb, or bump which the vehicle 10 may typically encounter in an outdoor setting. On a flat support surface, the ramp assist wheel 94 is positioned slightly thereabove so as not to contact the support surface. However, as the vehicle 10 approaches a raised surface area, the front of the vehicle would be raised as well to prevent frame damage.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A self-propelled personal mobility vehicle for transporting a person comprising a frame supported generally horizontally above the ground by two closely spaced side-by-side rear wheels steerable about a generally upright steering axis and two spaced front wheels; said steering axis positioned along a central longitudinal axis of, and rearwardly of said frame; first drive means operably connected between said front wheels for propelling said vehicle; second drive means operably connected between said frame and said rear wheels for controlledly rotationally positioning said rear wheels about said steering axis through an angle of up to about 90° in either direction from said longitudinal axis; a seat connected to and upwardly extending from said frame; control means including a hand-actuated lever supported on said seat for selectively controlling the rotational speed of said first drive means and the rotational steering positioning of said rear wheels by selective activation of said second drive means; a stored source of electric power mounted on said frame and operably connected between said control means and said first and second drive means; said front wheels being spaced apart along a common transverse axis and positioned in close proximity to the perimeter of said frame; an anti-tip wheel connected on each side of said frame between each said front wheel and said rear wheels and extending outwardly from the perimeter of said frame; each said anti-tip wheel positioned vertically just above a support surface of said vehicle whereby one said anti-tip wheel will contact the support surface when said frame is tilted laterally from an at-rest generally horizontal position above the support surface; said first drive means is a transaxle assembly whereby driving power is shared between said front wheels while turning movement of said vehicle is unincumbered thereby.

2. A personal mobility vehicle as set forth in claim 1, further comprising:

a cushioned anti-scuff wheel connected on each side of said frame and held for rotation about an upright axis above each said anti-tip wheel;

each said anti-scuff wheel positioned radially outwardly from the perimeter of said frame and rearwardly of the widest transverse dimension of said frame whereby said rear wheel will not contact a straight wall surface when said frame and one said anti-scuff wheel are simultaneously in contact with the wall surface.

3. A personal mobility vehicle as set forth in claim 2, further comprising:

an upright freely rotatable ramp assist wheel longitudinally oriented and disposed centrally beneath a forward portion of said frame;

said ramp assist wheel positioned vertically above the support surface whereby said ramp assist wheel will make an initial contact of said vehicle with a ramp or bump of a predetermined minimum height above the support surface as said vehicle is driven over the ramp or bump.

4. A personal mobility vehicle as set forth in claim 1, wherein:

a horizontal axis of rotation between said rear wheels intersects with said steering axis.

5. A self-supported personal mobility vehicle for transporting a person comprising frame means supported above the ground by a pair of side-by-side rear wheels steerable about an upright steering axis positioned rearwardly of said frame means and two spaced apart motor-driven front wheels for supporting the person in a seat connected to, and upwardly extending from said frame means; first drive means operably connected between said front wheels for propelling said vehicles; second drive means operably connected between said frame and said rear wheels for controlledly rotationally positioning said rear wheels about said steering axis; control means including a hand-actuated lever supported on said seat for selectively controlling the rotational speed of said first drive means and the rotational steering positioning of said rear wheel by selective activation of said second drive means; battery means operably connected between said control means and said first and second drive means; said front wheels being spaced apart along a common transverse axis and positioned in close proximity to the perimeter of said frame; said first drive means is a transaxle assembly whereby driving power is shared between said front wheels while turning movement of said vehicle is unincumbered thereby.

6. A personal mobility vehicle as set forth in claim 5, further comprising:

an anti-tip wheel connected on each side of said frame between each said front wheel and said rear wheel and extending outwardly from the perimeter of said frame;

each said anti-tip wheel positioned vertically just above a support surface of said vehicle whereby one said anti-tip wheel will contact the support surface when said frame is tilted laterally from an at-rest generally horizontal position above the support surface.

7. A personal mobility vehicle as set forth in claim 6, further comprising:

a cushioned anti-scuff wheel connected on each side of said frame and held for rotation about an upright axis above each said anti-tip wheel;

each said anti-scuff wheel positioned radially outwardly from the perimeter of said frame and rearwardly of the widest transverse dimension of said frame whereby said rear wheel will not contact a straight wall surface when said frame and one said anti-scuff wheel are simultaneously in contact with the wall surface.

8. A personal mobility vehicle as set forth in claim 7, further comprising:

an upright freely rotatable ramp assist wheel longitudinally oriented and disposed centrally beneath a forward portion of said frame;

said ramp assist wheel positioned vertically above the support surface whereby said ramp assist wheel will make an initial contact of said vehicle with a ramp or bump of a predetermined minimum height above the support surface as said vehicle is driven over the ramp or bump.

9. A personal mobility vehicle as set forth in claim 5, wherein:

said rear wheels are non-trailing.

* * * * *